United States Patent [19]

Nunlist

[11] Patent Number: 4,538,543

[45] Date of Patent: Sep. 3, 1985

[54] APPARATUS FOR APPLYING INTERNAL COATINGS IN HOT VESSELS

[75] Inventor: Erwin J. Nunlist, Penfield, N.Y.

[73] Assignee: Kennecott Corporation, Cleveland, Ohio

[21] Appl. No.: 668,594

[22] Filed: Nov. 5, 1984

[51] Int. Cl.[3] ..... B05B 1/06; B05B 7/20

[52] U.S. Cl. ..... 118/308; 118/318; 118/317

[58] Field of Search ..... 118/308, 318, 317; 239/683, 676, 687, 132.3, 132.1, 672, 184, 178

[56] References Cited

U.S. PATENT DOCUMENTS

| | | | |
|---|---|---|---|
| 3,016,875 | 1/1962 | Ballentine et al. | 118/318 X |
| 3,351,289 | 11/1967 | Demaison | 239/132.3 |
| 3,439,911 | 4/1969 | Barnard et al. | 239/132.3 |

FOREIGN PATENT DOCUMENTS

| | | | |
|---|---|---|---|
| 993463 | 5/1965 | United Kingdom | 239/687 |

*Primary Examiner*—Shrive P. Beck

*Attorney, Agent, or Firm*—R. Lawrence Sahr

[57] ABSTRACT

The present apparatus facilitates feeding a particulate vitreous material, such as glass or enamel, into a horizontally rotating tubular article, such as a tank or vessel, heated to the fusion point of the vitreous material, usually temperatures of 1500° F. or above, to coat the article with a fused coating. The present boom is comprised of a rigid elongated outer tube having a downstream end and an upstream end, the downstream end is adapted to be directed into the interior of the article that is to be coated. The elongated outer tube encloses an elongated, rigid feed tube, suitably concentrically positioned therein. The feed tube has a means of receiving and transporting a supply of finely divided vitreous material, e.g., glass frit, therethrough. A distributing means such as a nozzle or spray head, is positioned in the downstream end of the outer tube and internally connected to the feed tube. The apparatus has internal cooling ducts, formed by an elongated, rigid tube positioned intermediate to the feed tube and the outer tube, preferably aligned concentrically with each. The ducts facilitate circulation of a supply of cooling medium, such as air, through the boom. The outer portion of the boom is covered with a layer of low mass insulation. The outside of the insulation may suitably be covered with a reflective surface, such as particulate magnesium oxide.

8 Claims, 2 Drawing Figures

APPARATUS FOR APPLYING INTERNAL COATINGS IN HOT VESSELS

BACKGROUND OF THE INVENTION

The present invention relates to a boom, or lance, for applying vitreous coatings, such as glass, or enamel, to the internal surface of a heated horizontally rotating, cylindrical article, such as a vessel, or tank to form a thin, uniform, continuous, fused coating thereon.

Glass lined vessels have found widespread use in numerous industries, particularly those industries which require the storage or reaction of corrosive materials. Such vessels find use in extraction, suspension and distillation processes. The glass lining facilitates the use of the vessels under numerous adverse temperature and corrosive corrosive conditions.

Various methods and apparatus have been proposed to apply internal coatings to tubular articles such as reactors. Typical examples of these are: U.S. Pat. Nos. 3,351,289; 3,484,266; 3,827,633; 3,876,190, and 4,150,176. Generally booms, or lances, consisting of an elongated tubular member are utilized. Coating material is fed in one end, transported through the tube portion, to and through, a distribution means located in the furnace end of the boom. The article being coated is typically heated and rotated, while the coating material is distributed therein. As the boom moves through the length of the rotating article the interior of the article is coated.

In coating vitreous material such as glass on steel, it is imperative that an integral coating be obtained. Small defects such as, areas not coated completely, pinholes, blisters, or abrasions, result in rapid deterioration of the substrate adjoining the defective area especially when the coated article is subjected to corrosive conditions.

The prior art methods using a particulate coating material, such as glass, typically utilize it in a carrier such as water. The mixture is applied to the interior of the article being coated. After the mixture is applied, the article is dried to remove the carrier and subsequently fired to obtain the finished coated article. If defects in the coating are found after cooling the process is repeated. Most prior art processes, such as U.S. Pat. No. 3,484,266, noted above, initially distribute particulate materials on the vessel surface and subsequently in a separate step fuse the particles to obtain the finished coating. The reason a subsequent and completely separate firing step is required, is that mechanical apparatus, such as, glass feeding and dispensing mechanisms, do not reliably operate at glass firing temperatures. Typically, such temperatures range between about 1500° and about 1700° F. In addition, the particulate feed material frequently becomes tacky at such high temperatures leading to uneven distribution and a faulty coating.

U.S. Pat. No. 3,788,874 teaches a method of glass coating by maintaining the article to be coated at a temperature at least as high as the fusion point of the glass, while depositing glass particles on the article at a rate no greater than the rate at which the particles fuse to the article. While this method has many advantages it has not been widely utilized on a commercial basis because equipment to facilitate the commercial use of the method has not been developed. The present invention provides a boom by which the method of the U.S. Pat. No. 3,788,874 patent may be carried out. The teachings of the U.S. Pat. No. 3,788,874 patent are incorporated herein by reference.

BRIEF DESCRIPTION OF THE INVENTION

The present invention facilitates feeding and distributing a particulate vitreous material, such as glass or enamel, into a horizontally rotating tubular article, such as a tank or vessel, heated to the fusion point of the vitreous material, usually temperatures of 1500° F. or above, to coat the article with a fused coating. The coating applied may be a ground or cover coat or a combination of coats.

The present boom is comprised of a rigid elongated outer tube having a downstream end and an upstream end, the downstream end is adapted to be directed into the interior of the article that is to be coated. The elongated outer tube encloses an elongated, rigid feed tube, suitably concentrically positioned therein. The feed tube has a means of receiving and transporting a supply of finely divided vitreous material, e.g., glass frit, therethrough. A receiving and transporting means may suitably be a storage hopper and a conveyor belt or an auger feed. Although air is frequently utilized as a means of transporting particulate material, it is not particularly useful as a transport medium in the present apparatus because of the cooling effect that the exiting air would have on the wall of the article being coated and because of the loss of fine size particulate material which would be either carried out by the air exiting the furnace or undesirably deposited on portions of the article being coated or the furnace walls.

A distributing means such as a nozzle or spray head, is positioned in the downstream end of the outer tube and internally connected to the feed tube. Thus, the particulate material may be fed into the feed tube from a point outside the furnace, or heated area, transported through the feed tube, and distributed in the interior of the heated article being coated.

The boom also has an internal cooling duct, or ducts, formed by an elongated, rigid tube positioned intermediate to the feed tube and the outer tube, preferably aligned concentrically with each. The intermediate tube provides two annular ducts, an inner and an outer. The ducts facilitate circulation of a supply of cooling medium through the boom. The cooling medium enters one annular duct and exits the other. The cooling medium preferably is air. Although a liquid may be used, it is not preferred, as liquid leakage within the heated article would be highly undesirable. The outer tube of the boom is covered with a layer of low mass insulation, such as Fiberfrax ® ceramic fiber insulation, a product of The Carborundum Company. The outside of the insulation may suitable be covered with a reflective surface, such as particulate magnesium oxide.

With the foregoing arrangement it has been found that a boom operating at a firing temperature of about 1500° to about 1700° F. maintains a temperature of about 200° F. in the center portion of the boom. This temperature is sufficiently low that problems are not encountered with mechanical apparatus. If it is desired to preheat the finely divided vitreous material, as may be useful with some types of glass coating operations, a portion of the insulation may be removed from the boom.

The boom is moveable up and down, or sideways, suitably by a hydraulic means and may be moved in and out of the vessel, suitably by roller or track means.

In a particularly useful embodiment, the boom is equipped with optical scanning equipment located in the downstream portion. The optical scanning equipment allows an operator at a remote location to inspect the coating within the heated rotating vessel. If defects, such as, areas which are not covered, or not satisfactorily covered are found, the boom may be immediately repositioned and vitreous material fed to remedy the situation. Heretofore, such defects were not usually discovered until the article was cooled and a manual visual inspection made and if a defect was found, the heating process had to be repeated. In contrast the present invention allows an inspection, in situ, under furnace conditions, and provides a means to immediately correct the defect.

In an alternative embodiment that is particularly useful in coating elongated articles, such as long vessels, the boom may be partially supported by magnets. When the article to be coated is elongated, the boom in turn must be elongated and the problem of supporting the downstream, or furnace end of the boom is increased. Contact of the boom with the interior of the article being coated causes undesired abrasions and leads to subsequent coating difficulties. Solutions such as levered or cantilevered, booms have been proposed. Frequently only a small force is needed to maintain the boom out of contact with the internal surface of the article. In the present invention magnetic force is used to prevent such contact and maintain the boom in spaced relation to the article being coated. In accord with this embodiment at or near the bottom of the internal surface of the article being coated adjacent the point of entrance of the boom. The magnetic force is arranged to repel the ferrous boom. Thus the boom is maintained out of contact with the article being coated. Desirably the magnetic force is provided by magnets fabricated of ceramic materials adapted to withstand the relatively high firing temperatures.

DETAILED DESCRIPTION OF THE INVENTION

A preferred embodiment of the invention will now be described in detail by reference to the accompanying drawings in which like components are designated by similar numbers.

FIG. 1 also illustrates the boom as it would be positioned in a vessel.

Figure 1:
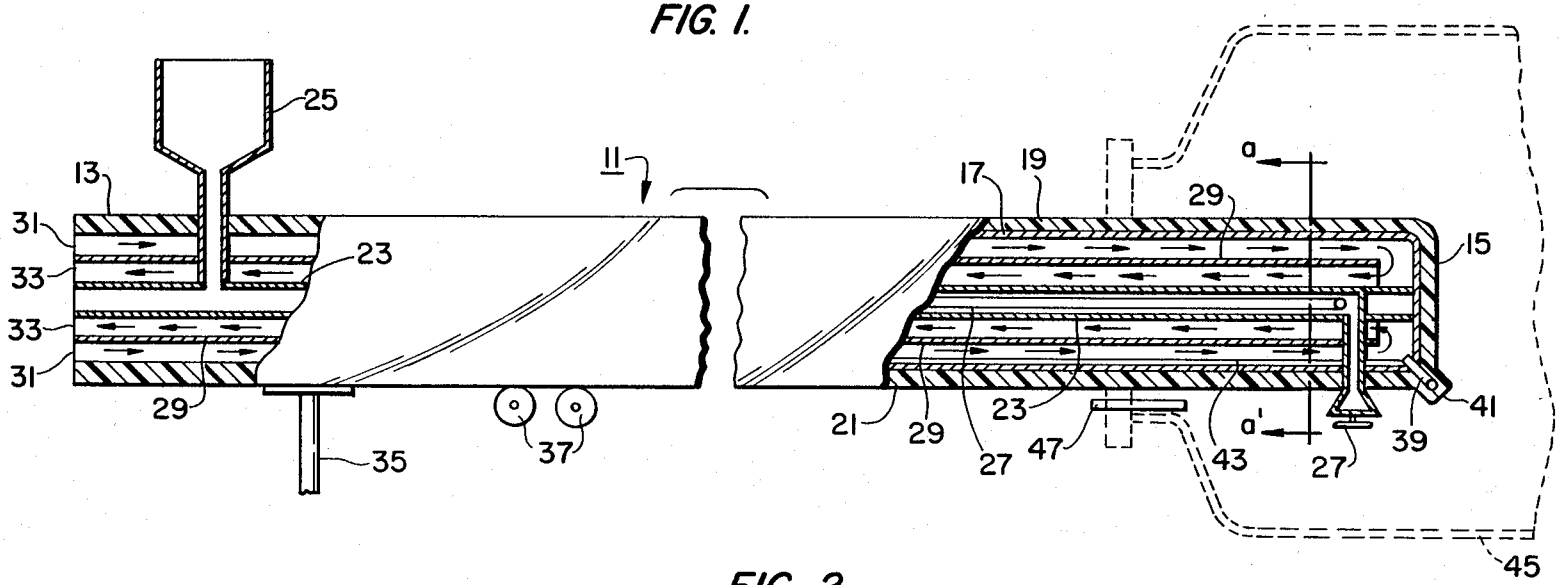
FIG. 1 is a side elevational view, partly in crosssection, of the present boom.
Figure 2:
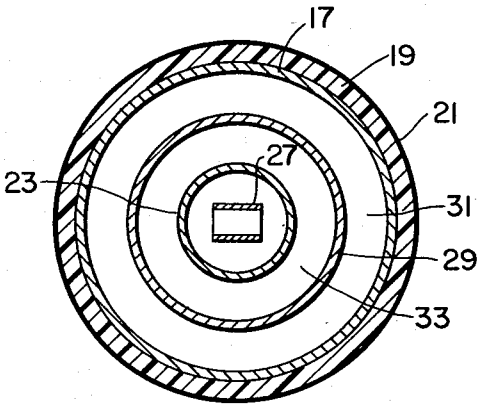
FIG. 2 is a frontal elevational view, partly in crossection, taken along a–a′ of FIG. 1.

Now looking at the figures in detail. Feed boom, suitably fabricated of a ferrous metal, such as, iron or steel, generally indicated by 11, has an upstream end 13 and a downstream end 15. Boom 11 has outer tube 17 which suitably is enclosed with a layer of low mass insulation 19 and having a layer of reflective material 21 suitably of particulate magnesium oxide enclosing insulation 19. Outer tube 17 encloses feed tube 23. Feed tube 23 is connected with a supply hopper such as 25 and has a means of transporting finely divided, particulate, vitreous material therethrough, such as, belt conveyor 27. Although an auger or screw feed may be used, it is preferred, because of weight consideration, to utilize a belt conveyor feed. Typically the size of the particulate feed material, preferably glass frit, is between about 20 and about 325 U.S. mesh, with a particularly preferable size range being −60+200 U.S. mesh. The downstream end 15 of outer tube 17 has a distribution means, such as 27 positioned therein. Distribution means 27, suitably a rotary spreader is connected internally to feed tube 23.

Internal annular space between feed tube 23 and the inside wall of tube 17 is suitably used as a cooling duct by directing a supply of cooling medium therethrough. As shown, intermediate tube 29 is positioned between feed tube 23 and outer tube 17. Tube 29 is positioned to direct a flow of cooling medium, preferably air, in inlet 31, through annular ducts formed by the space between the interior of outer tube 17, the outer surface of intermediate tube 29, as shown by the directional arrows. The cooling medium exits through the annular duct formed by the inner surface of intermediate tube 29 and the outer surface of feed tube 23, as shown by the arrows, and through outlet 33. It will be understood that although the flow of the cooling medium is shown as entering from the outside annular duct and exiting from the inside annular duct, the flow may be reversed if desired. In such case the cooling medium would enter the inner duct and exit the outer duct.

Boom 11 has means to raise and lower the downstream end, e,g., linkage 35, suitably hydraulically operated. Boom 11 also has means to move the boom forward and backward, e.g., rollers 37.

Optionally the present boom may include an optical viewing means, such as, optical scanner 39 positioned in the downstream end of boom 11, allowing an operator positioned in a remote area to inspect the interior of the article, such as vessel 45, shown in dashed lines, being coated while a coating operation is being carried out. In this embodiment, the feed means is stopped and cover 41 remotely mechanically lifted from optical means 39, which suitably consists of a lens and a means of transmitting an optical image, such as cable 43 to a remote location. The operator at such location inspects the fused coating, and if required, moves the boom to coat, recoat, or touch up internal areas of the vessel being coated.

In an alternate embodiment, particularly useful in coating elongated vessels, boom 11 is maintained out of contact with the vessel by means of magnetic force, such as permanent or electromagnets, 47. Magnets 47 are positioned at, or adjacent to, the opening in the vessel which receives the boom and are adjusted to repel ferrous boom 11 and maintain it out of contact with the vessel, thus avoiding abrading the vessel interior, which would seriously affect the integrity of the coating being applied. Alternatively a magnet or magnets may be placed in the downstream portion of the boom and positioned to be repelled by magnets located below the boom or by a ferrous vessel, such as 45.

It will be understood that various changes may be made in the form, construction, and arrangement of the parts herein without departing from the spirit and scope of the invention and that the examples are to be interpreted as illustrative and not in a limiting sense.

What is claimed is:

1. An apparatus for feeding particulate vitreous material into a horizontal, rotating article maintained at a temperature of at least 1500° F., to coat the interior of said article comprising:

an elongated rigid outer tube having a downstream end adapted to be directed into the interior of the article to be coated;

said outer tube enclosing therein an elongated, rigid, feed tube having a means of receiving and transporting a supply of finely divided vitreous material therethrough;

a distribution means positioned in the downstream portion of said outer tube, adapted to distribute finely divided vitreous material;

a connection between said inner feed tube and said distribution means to allow a flow of finely divided vitreous material through said feed tube into said distribution means;

a cooling duct formed by an elongated, rigid tube positioned intermediate said outer tube and said inner feed tube adapted to receive and circulate a supply of cooling medium therethrough; and said outer tube having a layer of low mass insulation thereon, and said layer of insulation having an outside reflective surface.

2. The apparatus of claim 1 wherein the finely divided vitreous material is glass frit.

3. The apparatus of claim 1 wherein the distribution means is a rotary spreader.

4. The apparatus of claim 1 wherein the means of transporting said finely divided vitreous material is a belt conveyor.

5. The apparatus of claim 1 wherein the outside reflective surface is particulate magnesium oxide.

6. The apparatus of claim 1 wherein the downstream portion of said tube has an optical scanner.

7. The apparatus of claim 1 wherein the cooling medium is air.

8. The apparatus of claim 1 wherein magnetic means are provided to maintain the apparatus out of contact with the article being coated.

* * * * *